US007415929B1

(12) United States Patent
Faughn

(10) Patent No.: US 7,415,929 B1
(45) Date of Patent: Aug. 26, 2008

(54) SYSTEMS WITH BORE-LAUNCHED PROJECTILES

(75) Inventor: Jim A. Faughn, Glen Arm, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 154 days.

(21) Appl. No.: 11/345,676

(22) Filed: Feb. 1, 2006

(51) Int. Cl.
*F42B 7/04* (2006.01)
*F42B 7/08* (2006.01)

(52) U.S. Cl. ..... 102/457; 102/448

(58) Field of Classification Search ..... 102/438, 102/448, 457
See application file for complete search history.

(56) References Cited

U.S. PATENT DOCUMENTS

| | | | | | |
|---|---|---|---|---|---|
| 579,429 | A | * | 3/1897 | Elliiott | 102/457 |
| 814,511 | A | * | 3/1906 | Bennett | 102/457 |
| 820,459 | A | * | 5/1906 | White | 102/457 |
| 1,096,272 | A | * | 5/1914 | Sherman et al. | 102/457 |
| 2,002,036 | A | * | 5/1935 | McGavock | 102/449 |
| 2,354,451 | A | * | 7/1944 | Forbes | 102/438 |
| 3,074,344 | A | * | 1/1963 | Devaux | 102/454 |
| 3,762,329 | A | * | 10/1973 | Mawhinney | 102/448 |
| 3,937,124 | A | | 2/1976 | Krumes | |
| 4,006,688 | A | * | 2/1977 | Craft et al. | 102/457 |
| 4,167,904 | A | * | 9/1979 | Ferri | 102/452 |
| 4,635,555 | A | * | 1/1987 | Ferri | 102/453 |
| 4,664,034 | A | | 5/1987 | Christian | |
| 4,815,389 | A | * | 3/1989 | Jakonczuk | 102/453 |
| 5,189,251 | A | | 2/1993 | Puckett | |
| 5,191,168 | A | | 3/1993 | Puckett | |
| 5,192,830 | A | | 3/1993 | Puckett | |
| 5,413,050 | A | * | 5/1995 | Maki | 102/457 |
| 5,644,100 | A | | 7/1997 | Puckett et al. | |
| 5,874,689 | A | * | 2/1999 | Alkhatib et al. | 102/453 |
| 6,202,561 | B1 | | 3/2001 | Head et al. | |
| 6,367,388 | B1 | * | 4/2002 | Billings | 102/454 |
| 6,557,290 | B2 | | 5/2003 | Kumler | |

* cited by examiner

*Primary Examiner*—Bret Hayes
(74) *Attorney, Agent, or Firm*—William V. Adams; A. David Spevack

(57) ABSTRACT

Systems for launching one or more projectiles from a bore are provided. An exemplary system incorporates a shell, a projectile, an explosive charge and a wad. The shell includes a base and a casing, with the casing defining an interior. The projectile is located within the interior and is configured to be expelled from the shell casing. The explosive charge is located within the interior and is configured to expel the projectile from the casing. The wad is located within the interior and is configured to expel the projectile from the casing in response to detonation of the explosive charge. The wad includes petals and a petal stop, with the petals being movable between a closed position, in which free ends of the petals are arranged proximate to each other such that the petals at least partially surround the projectile, and an open position, in which the free ends of the petals are displaced from each other, the petal stop being configured to limit movement of the petals beyond the open position. Responsive to being expelled from a bore by detonation of the explosive charge, the petals move from the closed position to the open position, thereby retarding the wad and releasing the projectile.

4 Claims, 3 Drawing Sheets

SYSTEMS WITH BORE-LAUNCHED PROJECTILES

GOVERNMENT INTEREST

The invention described herein may be manufactured, used, and licensed by or for the United States Government.

BACKGROUND

1. Technical Field

The invention generally relates to projectiles.

2. Description of the Related Art

A typical shotgun shell is formed of several basic components, including a shell base, a shell casing, primer, an explosive charge, a wad, and one or more projectiles usually shot. The wad surrounds the shot, with the wad and shot being located within an interior that is defined by the shell casing. The explosive charge is located between the wad and the shell base, with the primer being seated in the shell base.

The primer is used to ignite the explosive charge. Gas formed by the explosive charge pressurizes the interior of the shell casing and forces the wad and encased shot out of the shell casing and away from the shell base. As the wad and shot enter the bore of the shotgun in which the shotgun shell is loaded, the wad swells to seal against the inner wall of the bore. The pressure of the gasses continues to push the wad and encased shot through the bore until the wad and shot are expelled from the muzzle of the shotgun. As the wad exits the muzzle, segmented leaves or petals of the wad bend backward toward the muzzle due to air resistance. This causes a decrease in the forward motion of the wad and enables the shot to be released. The shot continues moving in a manner dictated by the force imparted to the shot by the wad and by any shape or constriction of the muzzle.

SUMMARY

Systems for launching a projectile from a bore are provided. An exemplary embodiment of such a system incorporates a shell, a projectile, an explosive charge, and a wad. The shell includes a base and a casing, with the casing defining an interior. The projectile is located within the interior and is configured to be expelled from the shell casing. The explosive charge is located within the interior and is configured to expel the projectile from the casing. The wad is located within the interior and is configured to expel the projectile from the casing in response to detonation of the explosive charge. The wad includes petals and a petal stop, with the petals being movable between a closed position, in which free ends of the petals are arranged proximate to each other such that the petals at least partially surround the projectile, and an open position, in which the free ends of the petals are displaced from each other, the petal stop being configured to limit movement of the petals beyond the open position. Responsive to being expelled from a bore by detonation of the explosive charge, the petals move from the closed position to the open position, thereby retarding the wad and releasing the projectile.

Another exemplary embodiment of such a system incorporates a shell, one or more projectiles, an explosive charge, a wad, and a projectile director. The shell defines an interior. The projectile(s) is/are located within the interior and is/are configured to be expelled from the shell. The wad is located within the interior and is configured to expel the projectile(s) from the shell. The projectile director is located within the interior and includes an interior surface that is configured to alter a dispersal pattern of the projectile(s) as the projectile(s) is/are being separated from the wad in response to expulsion of the wad and the projectile(s) from the bore.

Still another exemplary embodiment is a close-quarters defensive or offensive shotgun shell round which configures the shot pattern to enhance target lethality zones and minimize collateral damage. The shell is adaptable to orient the shot pattern in a multitude of various patterns depending on the desired effect on the target. The round has the ability to spread and/or configure the shot pattern very quickly after exiting the muzzle of the delivery weapon or system allowing wide, concentrated, or configured dispersion of the shot very quickly and at very close ranges. The dispersion of the shot can be controlled or configured into a specific pattern eliminating stray and/or wasted projectiles which miss the intended target or hit unintended targets.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale relative to each other. Like reference numerals designate corresponding parts throughout the several views.

DETAILED DESCRIPTION

Systems with bore-launched projectiles are provided. Such systems include shotguns, as well as grenade launchers, firearms, rifles, and artillery pieces, for example. As will be described in detail, each of these systems launches a projectile(s) that is initially carried within a shell. Such a shell uses a wad for expelling the projectile(s), with the wad including petals. Specifically, the petals of such a wad encase the projectile(s) during travel through a bore, then open to release the projectile(s) when the wad is expelled from the bore. Notably, such a wad includes a petal stop that is configured to limit movement of the petals beyond the open position, thereby significantly enhancing the stopping effect of the wad. In some embodiments the petals are configured to cause rotation of the wad and projectile(s). Additionally, or alternatively, embodiments can include a projectile director that is configured to alter the dispersal pattern of the projectile(s).

Figure 1:
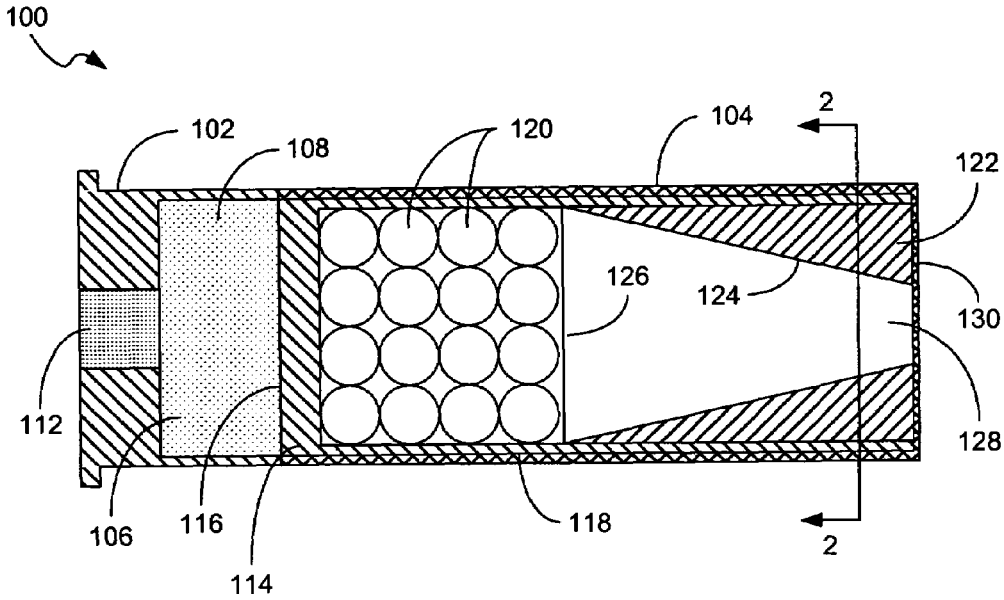
FIG. 1 is a schematic cross-sectional view of an embodiment of a shell.
Figure 2:
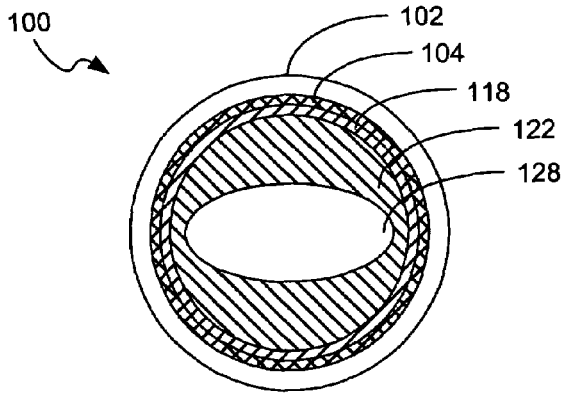
FIG. 2 is a schematic cross-sectional view of the embodiment of FIG. 1 that is viewed along section line 2-2.

Referring now the drawings, FIG. 1 is a schematic cross-sectional view of an embodiment of a shell 100 that includes bore-launched projectiles, with FIG. 2 being a schematic view along section line 2-2 of FIG. 1. In the embodiment shown in FIGS. 1 and 2, shell 100 is configured as a shotgun shell that includes a shell base 102 and shell casing 104. Shell base 102 and shell casing 104 define an interior 106. An explosive (or very rapidly burning) charge 108 is located within the interior 106 adjacent to the shell base 102, with the shell base seating a primer 112 that is used to ignite the explosive charge. A wad 114 also is located within the interior 106. The wad 114 includes a base 116, petals 118, and webbing 119 (FIG. 3), with the wad surrounding projectiles 120. In this embodiment, the projectiles 120 are shot. Note that the wad 114 also surrounds a projectile director 122.

Projectile director 122 is configured to control the dispersion pattern of the projectiles 120. In this regard, projectile director 122 includes an inner surface 124 that, in this embodiment, is shaped as a funnel. Specifically, the inner surface 124 defines an entrance end 126 that is located adjacent to the projectiles 120, and an exit 128 that is located at the distal end 130 of the shell casing 104. As is most readily apparent in FIG. 2, the exit end 128 exhibits an elongated major axis that is generally horizontal, so as to form an elongated slot that has a cross-sectional area that is smaller than that of the entrance end.

The shape of the projectile director 122 can be configured in a multitude of different orientations and configurations to direct the projectiles 120 in specific patterns or to provide dynamic motion to the projectiles. The projectiles 120 can be confined into a very concise pattern or dispersed into a very broad pattern. For example, the projectiles 120 can be conformed into a vertical line pattern and, with rapid dispersion, can attain a floor-to-ceiling span shortly after the wad 114 exits the muzzle of the delivery device, or can be configured into a horizontal spread (as in the configuration shown in FIG. 2). Dynamic motion can be imparted to the projectiles 120 as they pass over and through various channels, ramps, grooves, or other means incorporated in the projectile director 122 to direct and position the projectiles 120.

The projectiles 120 may be any type or shape of ammunition desired, such as steel shot, lead shot, sintered shot, plastic shot, rubber shot, etc. The type of projectiles used depends on the application. In addition, the orientation of the projectiles in the wad can be varied, as desired. Sintered shot is especially effective in reducing the likelihood of collateral damage.

Figure 3:
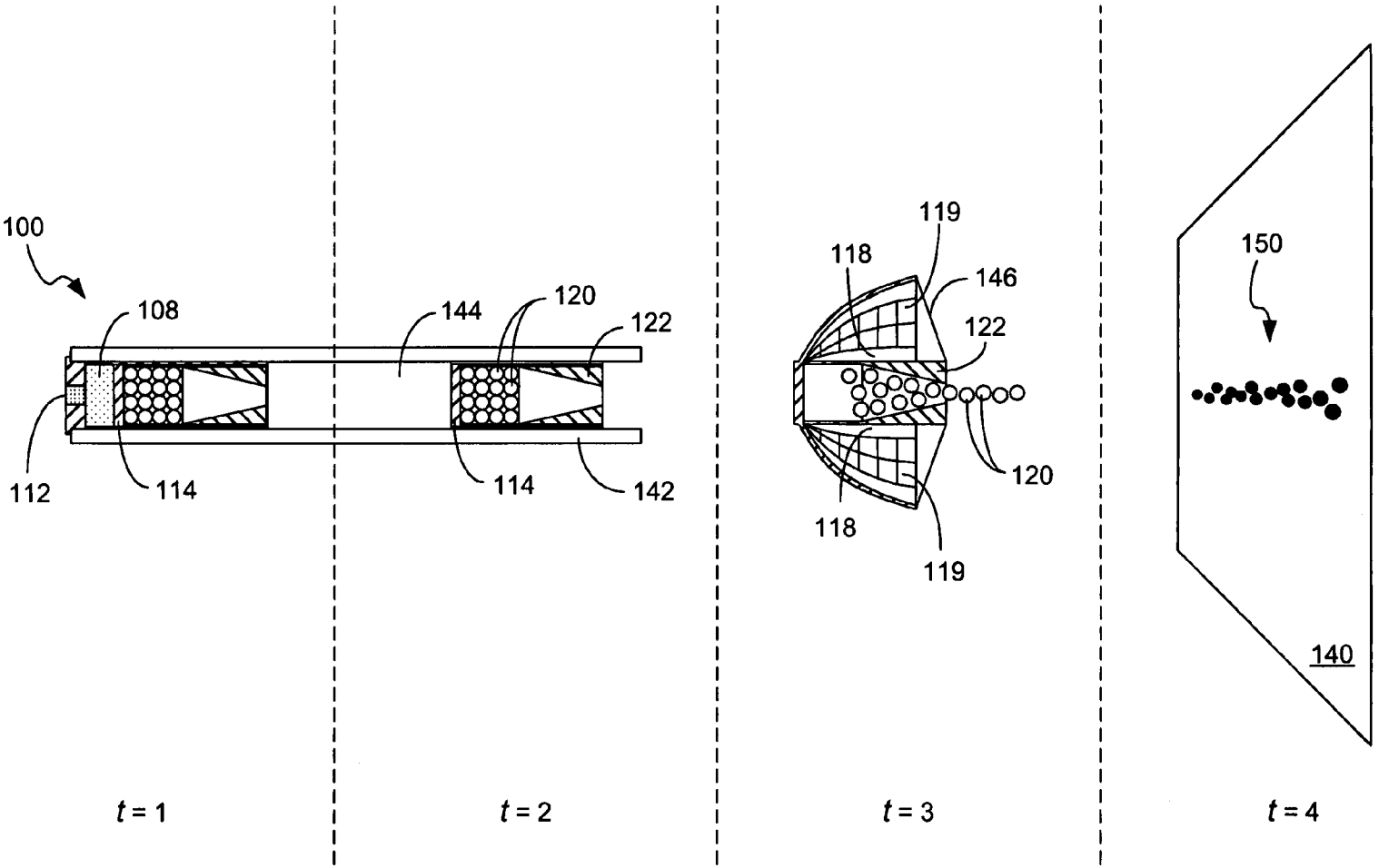
FIG. 3 is a schematic diagram depicting a firing sequence of the shell of FIGS. 1 and 2.

As shown schematically in FIG. 3, the projectiles 120 can be fired at a target 140 by loading the shell into the chamber of a delivery device, such as a shotgun (the barrel 142 and associated bore 144 being shown in FIG. 3) and igniting the primer 112 (at time t=1). Ignition of the primer 112, in turn, ignites the explosive charge 108, which generates gas as it rapidly combusts. Gas pressure produced by the explosive charge 108 forces the wad 114, projectiles 120, and projectile director 122 through the bore 144 (at t=2) until the wad, projectiles, and projectile director are expelled from the muzzle of the barrel 142.

Air resistance causes the petals 118 of the wad 114 to move rapidly from their closed position to an open position (shown at t=3). The open position is controlled by flexible webbing 119 that connects the petals 118 together. The webbing 119 dramatically increases the drag of the wad 114, thereby rapidly decelerating or braking the wad. As is also apparent in FIG. 3, the projectile director 122 is attached to the wad, such as via tethers 146, to rapidly decelerate the projectile director. Note, the tethers 146 also limit motion of the petals 118 beyond the open position to enhance braking of the wad 114.

The wad 114 can also take advantage of different methods to promote expansion and deployment of the petals 118 to further aid the rapid reduction of forward motion. A first method involves the process used to mold the wad. Instead of molding the petals 118 axially in line with the center axis of the wad, the petals can be molded in the open position, and therefore would be under tension to open when in the shell or muzzle. Another method involves inserting radial expanding springs compressed inside the wad 114, which expand when the wad leaves the muzzle, thereby pushing open the petals of the wad.

Other variations of the wad 114 can be implemented. In one variation, the petals 118 of the wad 114 are angled to spin one or more projectiles 120. The payload of such projectiles may include, but is not limited to, chemicals, tear gas, malodorants, etc. In another variation, the opening of the wad petals 118 can be delayed for dispersion of the projectiles 120 at a greater distance or to pass the projectiles through a window or other opening.

Returning to FIG. 3, continued forward motion of the projectiles 120 after the braking of the wad 114 causes the projectiles to be expelled from the wad in a manner dictated by the configuration of the projectile director 122. In the example embodiment of FIGS. 1 and 2, since the projectile director 122 is configured as a funnel with an exit end being elongated horizontally, the projectiles 120 disperse in a horizontally-elongated pattern (see pattern 150 at t=4).

Figure 4A:
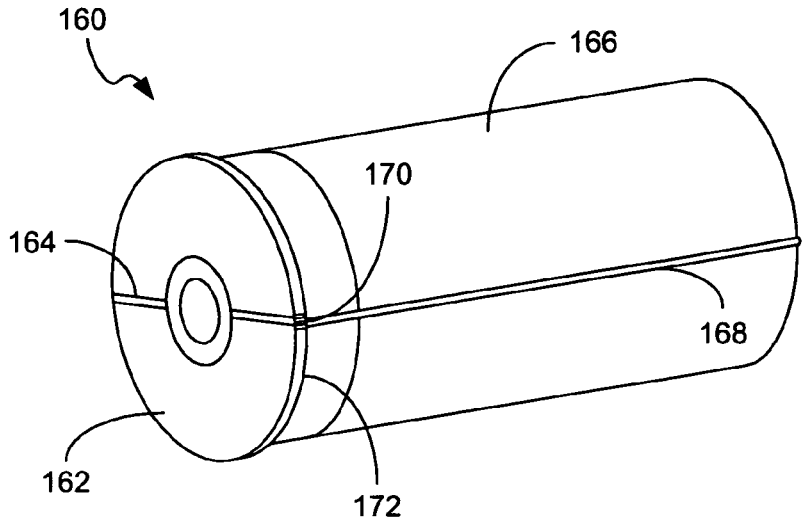
FIG. 4A is a schematic diagram of another embodiment of a shell.
Figure 4B:
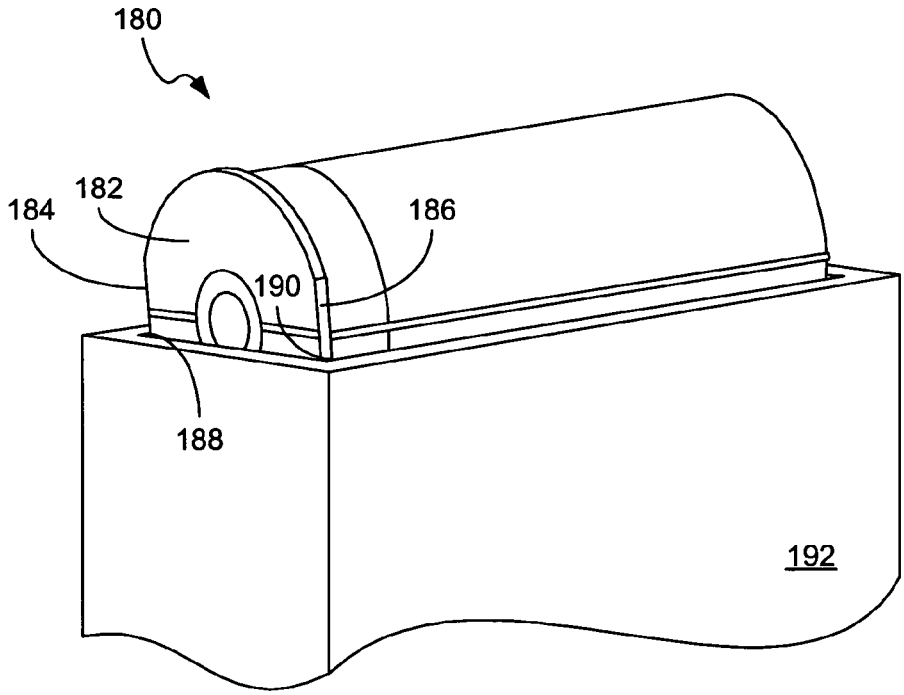
FIG. 4B is a schematic diagram of still another embodiment of a shell that is being loaded into a magazine.

As shown in FIGS. 4A and 4B, one or more features of the round (e.g., shell) can be used to control and identify the projectile dispersal pattern. In the example of FIG. 4A, shell 160 includes indicia that correspond to a horizontal dispersal pattern. Specifically, shell base 162 includes a colored line 164 that runs generally parallel to the intended dispersal pattern and the shell casing 166 includes an elongated protrusion 168 that runs generally parallel to the intended dispersal pattern. Note that a corresponding elongated protrusion (not shown) also can be included on the other side of the shell casing. Such protrusions can be used to prevent the shell from being inserted into and fired from a weapon that does not have corresponding indentations in the bore thus providing a level of security restricting the use of shells having a controlled projectile dispersal pattern. Furthermore, elongated indentations (not shown) could be used in place of the elongated protrusions. As is also shown in FIG. 4A, shell 160 includes notches 170 located along the edge 172 of shell base 162. Other indicators such as raised bars, circles, rectangles, and the like may be placed at the end of the round to convey the intent of the projectile pattern and can be especially designed for tactile identification in night or other low-light conditions.

In addition or in exception to the indicia previously described with respect to the embodiment of FIG. 4A, a round can include timing features that only permit loading of the round into a magazine/weapon in a particular orientation. In the embodiment of FIG. 4B, a shell 180 has a shell base 182 that includes opposing, parallel alignment surfaces 184, 186 that mate with alignment surfaces 188, 190 of a shell magazine 192. In operation, surfaces 184, 186 must align with surfaces 188, 190 for the shell 180 to be loaded into the magazine. Thus, the orientation of the shell 180 within the magazine 192 is known to the user and the characteristics of the projectile dispersal pattern can be controlled.

What is claimed is:

1. A system for launching projectiles from a bore, said system comprising:

a shell having a base and a casing, the casing defining an interior;

projectiles located within the interior and configured to be expelled from the shell casing;

an explosive charge located within the interior and configured to expel the projectiles from the casing; and a wad located within the interior and configured to expel the projectiles from the casing in response to detonation of the explosive charge, the wad having petals and at least one petal stop, the petals being movable between a closed position in which free ends of the petals are arranged proximate to each other such that the petals at least partially surround the projectiles, and an open position in which the free ends of the petals are displaced from each other, the at least one petal stop being configured to limit movement of the petals beyond the open position;

wherein, responsive to being expelled from a bore by detonation of the explosive charge, the petals move from the closed position to the open position, thereby retarding the wad and releasing the projectiles the system further comprising:

a projectile director located within the shell interior and being configured to alter a dispersion pattern of the one or more projectiles as the one or more projectiles is being separated from the wad; and means for rotating the wad and the projectiles;

further comprising:

a tether having a first end and a second end, the first end being attached to the free end of one of the petals, the second end being attached to the projectile director such that the tether limits motion of the free end of the petal beyond the open position.

2. The system of claim 1, wherein the alignment surface of the shell to ensure orientation of the shell with respect to the bore further comprises one or more protuberances which prevent the shell from being loaded into a bore which is not configured with a like number of corresponding indentations.

3. A method for controlling the dispersal of projectiles, said method comprising:

launching a wad that includes a plurality of projectiles and a projectile director having an exit that comprises a shape that controls dispersion of the projectiles from the wad; and decelerating the wad relative to the projectiles such that the projectiles pass through the projectile director exit in a predetermined dispersion pattern, wherein the projectile director exit is formed as an elongated slot so as to form an elongated projectile dispersion pattern.

4. The method of claim 3, wherein decelerating the wad comprises decelerating the wad with petals of the wad that open when the wad travels through the air and the petals are secured to the projectile director with tethers.

* * * * *